US007124701B2

(12) United States Patent
Valente

(10) Patent No.: US 7,124,701 B2
(45) Date of Patent: Oct. 24, 2006

(54) PROPULSION SYSTEM FOR SCUBA DIVER

(76) Inventor: Osvaldo Valente, Via Carpena No. 2, Portovenere Le Grazie (IT) 1-19022

( * ) Notice: Subject to any disclaimer, the term of this patent is extended or adjusted under 35 U.S.C. 154(b) by 0 days.

(21) Appl. No.: 10/534,963

(22) PCT Filed: Jan. 7, 2004

(86) PCT No.: PCT/IT2004/000001

§ 371 (c)(1),
(2), (4) Date: May 16, 2005

(87) PCT Pub. No.: WO2004/062744

PCT Pub. Date: Jul. 29, 2004

(65) Prior Publication Data

US 2006/0081167 A1 Apr. 20, 2006

(30) Foreign Application Priority Data

Jan. 9, 2003 (IT) ..... PI2003A0002

(51) Int. Cl.
*B63C 11/46* (2006.01)
*B63C 11/00* (2006.01)

(52) U.S. Cl. ..... 114/315; 405/185

(58) Field of Classification Search ..... 114/315; 405/185

See application file for complete search history.

(56) References Cited

U.S. PATENT DOCUMENTS

| | | | | |
|---|---|---|---|---|
| 2,722,021 | A | 11/1955 | Keogh-Dwyer | |
| 3,422,787 | A | 1/1969 | Rush | |
| 3,745,961 | A | 7/1973 | Laughman | |
| 3,916,814 | A * | 11/1975 | Bardoni et al. | 114/315 |
| 4,467,742 | A | 8/1984 | Duboy | |
| 4,753,187 | A | 6/1988 | Galimand | |
| 5,346,419 | A * | 9/1994 | Kaiser | 441/96 |

FOREIGN PATENT DOCUMENTS

WO WO-02/072382 9/2002

* cited by examiner

*Primary Examiner*—Jesús D. Sotelo
(74) *Attorney, Agent, or Firm*—David Guerra

(57) ABSTRACT

Electric Propulsion system supported by a special usable harness slinging from scuba divers, deep-sea divers or simple swimmers, advantageously fed by a sophisticated system of rechargeable batteries, inserted inside several united watertight containers between them. The innovative structure, allow to all specialized operators to move forward underwater even if the immersions will be made in depth and for prolonged for long time periods, through the use of a motorized propulsion module. Another characteristic of the system is that it will allow a user to move and be operated in complete freedom and under any condition.

18 Claims, 6 Drawing Sheets

1B
5F
5G
3

5D
5E
5C
4
5
5B

1

14D
15D
23
23B
22B
24
25
+
22
26
26B
9M
19I 20C
19L 9N
27
9□
27B 19M
26C
27C
9P
26D
19N

PROPULSION SYSTEM FOR SCUBA DIVER

CROSS-REFERENCE TO RELATED APPLICATIONS

This application is an U.S. national phase application under 35 U.S.C. §371 based upon co-pending International Application No. PCT/IT2004/000001 filed Jan. 7, 2004. Additionally, this U.S. national phase application claims the benefit of priority of co-pending International Application No. PCT/IT2004/000001 filed Jan. 7, 2004 and Italian Application No. IT PI2003A000002 filed Jan. 9, 2003. The entire disclosures of the prior applications are incorporated herein by reference. The international application was published Jul. 29, 2004 under Publication No. WO 2004/0627443 A1.

BACKGROUND OF THE INVENTION

1. Field of the Invention

The invention covers an innovative means of electric propulsion, validly supported by a special harness that can be used by scuba divers, deep-sea divers or simple amateurs, the entire apparatus advantageously powered by a sophisticated system of rechargeable batteries inserted inside various water tight containers joined together by means of interstices of rubber or other suitable technical material. As we know, the greatest difficulty faced by anyone working underwater is moving around. This difficulty, in certain particular conditions, increases exponentially, very severely testing the resistance even of the most qualified persons who, even if adequately prepared, can incur serious risks that can endanger their safety. The innovative structure will allow all amateurs or other specialized operators to move underwater without any problem, even if they are submerged in deep water for long periods of time. Another very important characteristic of the system is its reduced size, which will make it possible to move and work in complete freedom and under any conditions.

2. Description of the Prior Art

For the purposes of this patent application, there is no need to describe the various types of underwater propulsion currently in use, in that their operation is known to all technicians in the sector and constitute a known art, yet do not allow for a solution to the problem involved. The principal scope of the present invention is to eliminate the disadvantages mentioned above and provide all amateur and professional divers with a valid propulsion system that is technologically advanced and safe to use, capable of facilitating normal movements even under extreme conditions such as prolonged underwater stays or great depths. According to the invention, this result has been attained by adopting the technical solution of using a system with the characteristics described in the independent claims. Other characteristics of this invention are covered by the dependent claims.

SUMMARY OF THE INVENTION

In view of the foregoing disadvantages inherent in the known types of underwater propulsion devices, the present invention provides an improved propulsion system for scuba divers, and overcomes the above-mentioned disadvantages and drawbacks of the prior art. As such, the general purpose of the present invention, which will be described subsequently in greater detail, is to provide a new and improved propulsion system for scuba divers and method which has all the advantages of the prior art mentioned heretofore and many novel features that result in a propulsion system for scuba divers which is not anticipated, rendered obvious, suggested, or even implied by the prior art, either alone or in any combination thereof.

To attain this, the present invention essentially comprises at least one specific electric water jets or hydro-jets supported by a harness and powered by a power supply system consisting of a series of watertight containers all containing a rechargeable batteries. The power supply system has connecting interstices. The various cables of the power supply system and control circuit are contained inside a special watertight branch box. The entire propulsion system is controlled by watertight push buttons.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

The advantages of the present invention consist essentially of the fact that all scuba divers, deep-sea divers or simple amateurs, can validly use the system covered by the present invention in order to move around in total safety while they are submerged, having at their disposal a device of specific dimensions but very efficient and versatile. These and other advantages and characteristics of this invention will be better and more fully understood by every technician in the field from the following description and with the help of the attached drawings, given as exemplified embodiments of the invention, but not to be considered as limiting.

Figure 1:
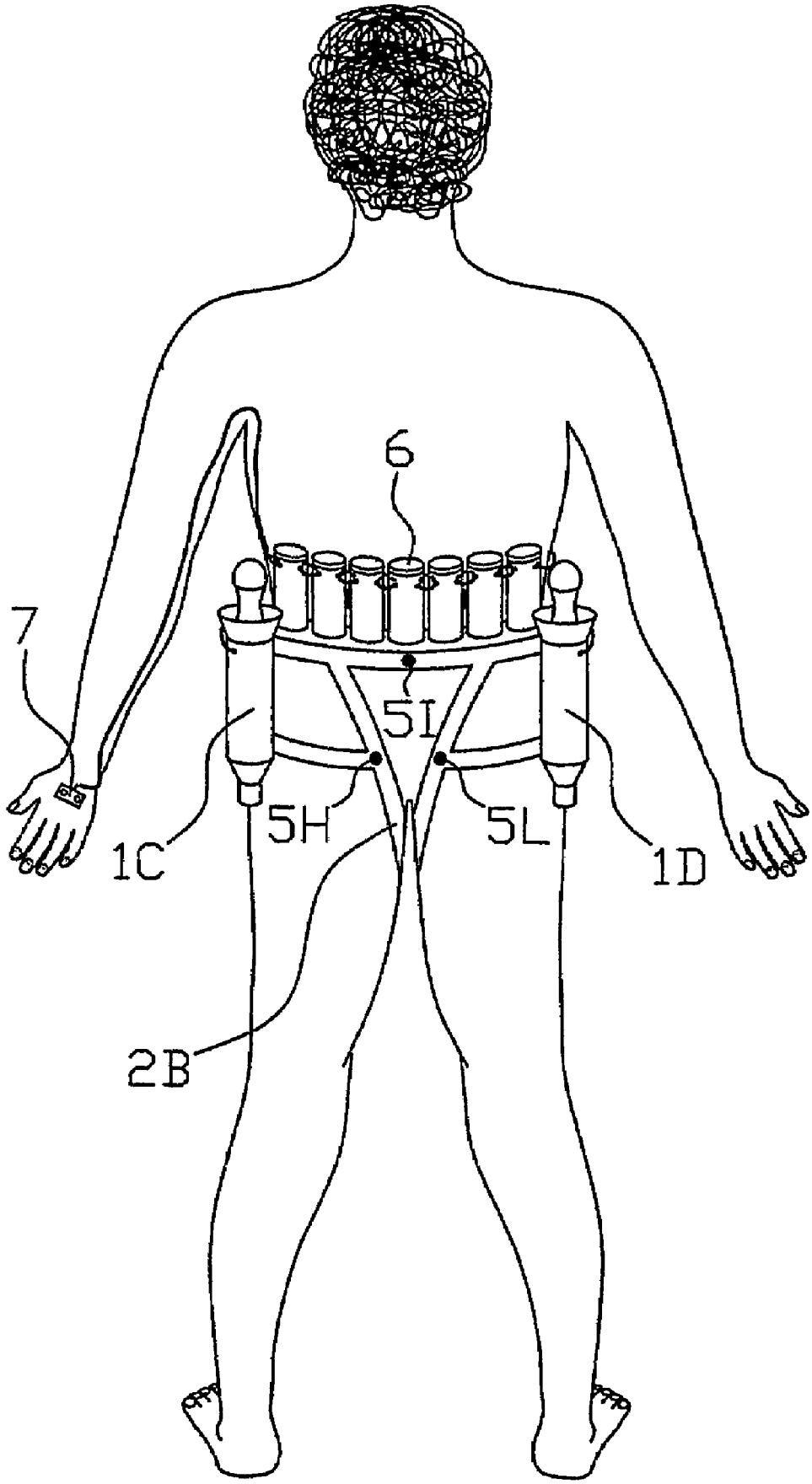
FIG. 1 is a perspective view of the preferred embodiment of the propulsion system for scuba divers constructed in accordance with the principles of the present invention.

FIG. 1 illustrates the complete propulsion system with all the accessories that comprise it and regularly worn by the user, with the following in sequence: the two specific water jets (1C, 1D); the harness (2B), correctly applied showing reinforced holes (5H, 5I, 5L) still free and ready to be advantageously used; the power supply system (6) consisting of various watertight containers containing traditional or rechargeable batteries, joined together by means of interstices made of rubber or other suitable material, described in detail in the following drawing tables; and the manual control consisting of a watertight switch (7) positioned in the palm of the hand inside the diving suit (7), able to turn on/turn off the various electrical devices ON or OFF.

Figure 2:
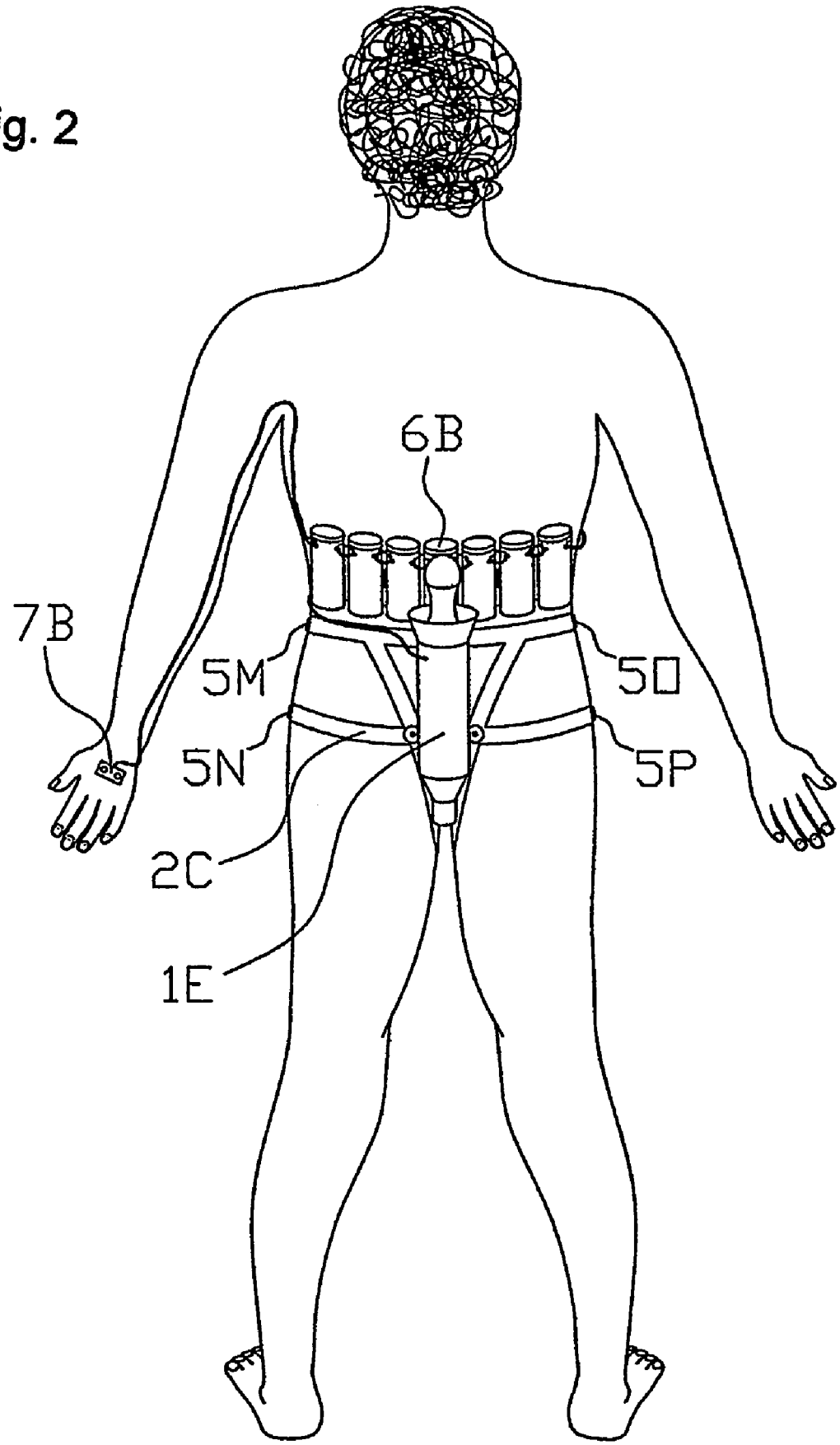
FIG. 2 is a perspective view of an alternate embodiment of the preferred embodiment of the propulsion system for scuba divers of the present invention.

FIG. 2 illustrates the complete propulsion system with all the accessories of which it is comprised and regularly worn by the user, with the two lateral specific water jets (not visible in the figure), validly replaced by one of larger dimensions (1E) centrally positioned. This solution may be adopted in the event that, for space reasons, other specific configurations are not recommended. FIG. 2 also illustrates in sequence: the harness (2C) correctly applied showing the reinforced holes (5M, 5N, 5O, 5P) ready to be advantageously used; the power supply system (6B) consisting of various watertight containers containing traditional or rechargeable batteries joined together by means of interstices made of rubber or other suitable material (described in detail in the following drawing tables); and the manual control consisting of a watertight switch (7B) positioned in the palm of the hand inside the diving suit, to turn the different electric/electronic equipment ON or OFF.

Figure 3:
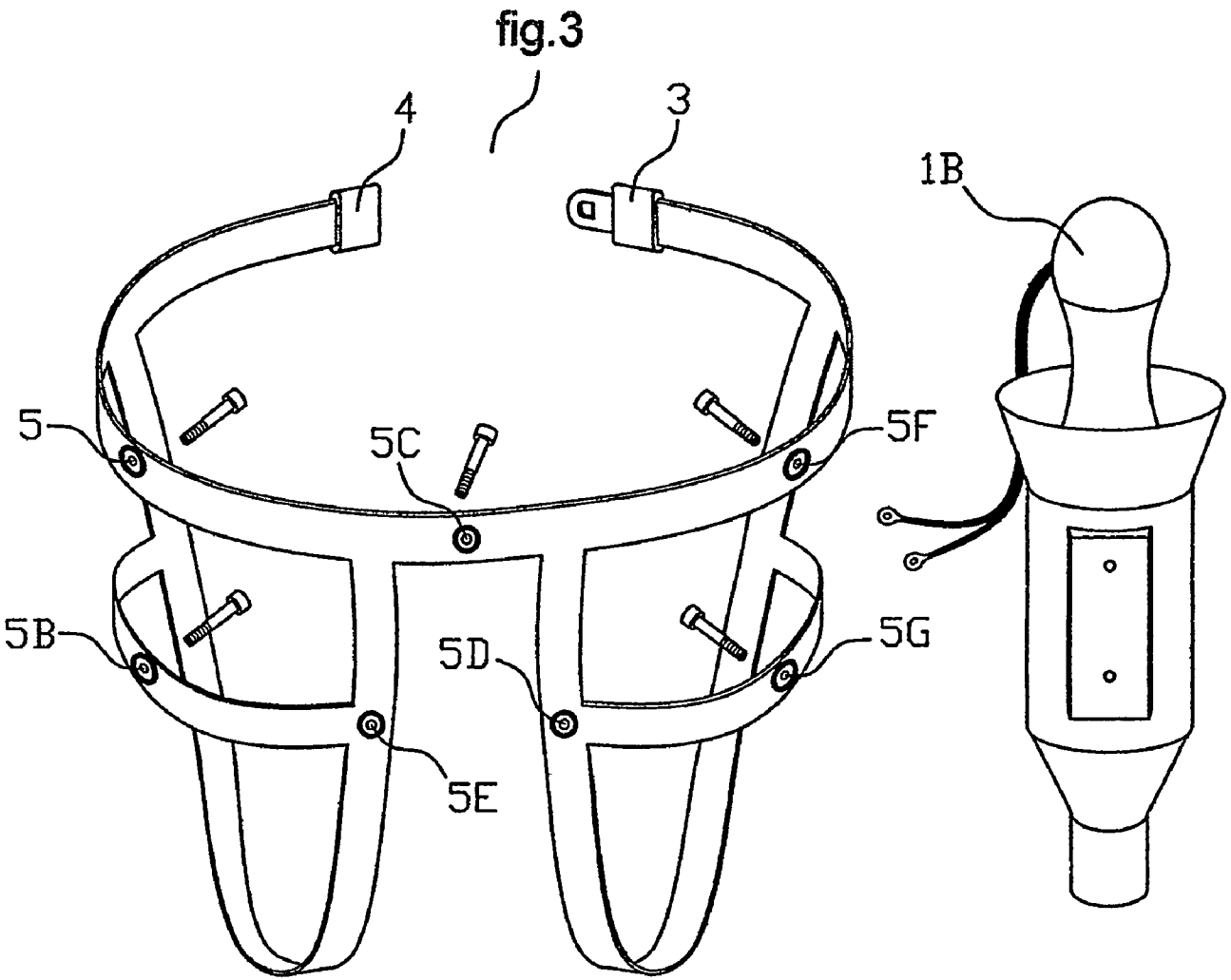
FIG. 3 is an exploded perspective view of the preferred embodiment of the propulsion system for scuba divers of the present invention.

FIG. 3 illustrates the propulsion system for scuba divers showing the special harness (2) complete with two hooks (3, 4) for tying it around the hips of the user and reinforced holes (5, 5B, 5C, 5D, 5E, 5F, 5G) that can hold various accessories such as the two special water jets (1, 1B) or other objects useful for diving. It is necessary to point out that the locking system, shown in the figure with the reinforced holes (5, 5B, 5C, 5D, 5E, 5F, 5G) where the relative bolts are inserted, is given by way of example only, since any number of other systems normally employed can be advantageously used without compromising correct operation.

Figure 4:
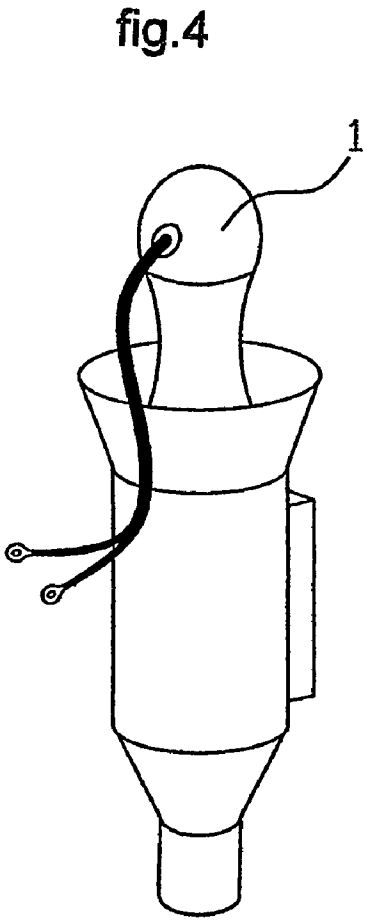
FIG. 4 is a perspective view of the hydro-jet of the preferred embodiment of the propulsion system for scuba divers of the present invention.

FIG. 4 illustrates the special water jet or hydro-jet (1) and its power cables.

Figure 5:
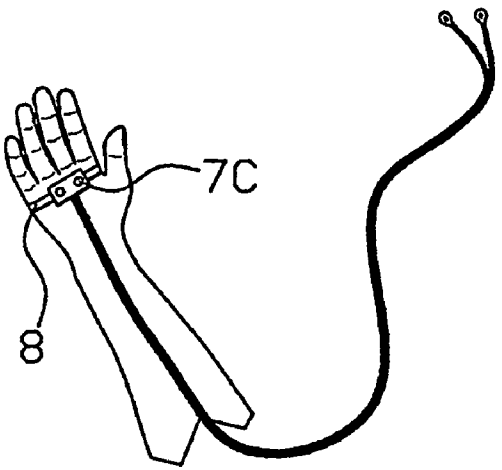
FIG. 5 is a perspective view of an alternate embodiment of the push button of the preferred embodiment of the propulsion system for scuba divers of the present invention.

FIG. 5 represents a variant applicable to the push button (7C), which in this case is equipped with a strap (8) that can attach it firmly to the palm of the hand, to be used mainly when the diver is not wearing a diving suit.

Figure 6:
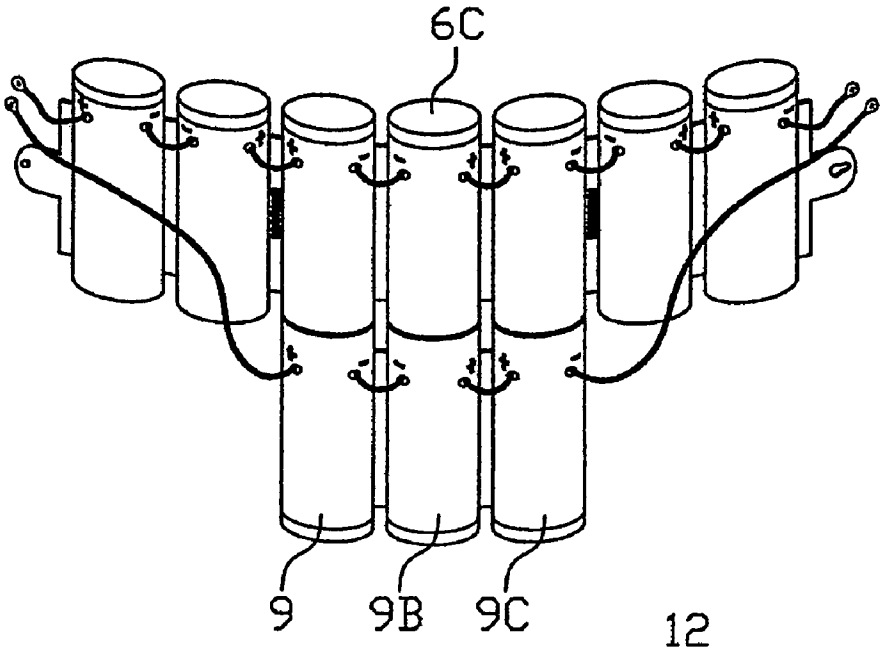
FIG. 6 is a perspective view of the power supply system of the preferred embodiment of the propulsion system for scuba divers of the present invention.

FIG. 6 on the other hand, presents the power supply system (6C) consisting of various watertight containers all containing traditional or rechargeable batteries joined together by means of interstices made of rubber or other suitable material, where three more specific watertight containers (9, 9B, 9C), also containing a traditional or rechargeable battery, have been applied thanks to the special recesses described in detail in the following tables. This addition, when space permits, serves to strengthen and increase the autonomy of the system.

Figure 7:
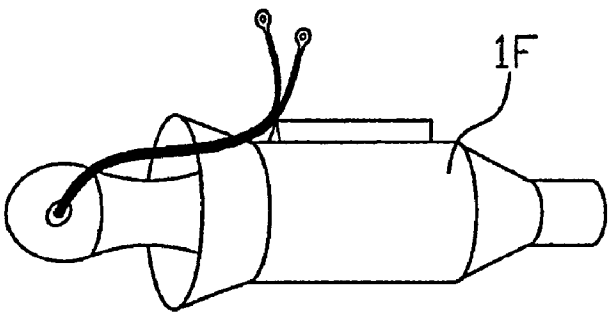
FIG. 7 is a perspective view of the specific water jet of the preferred embodiment of the propulsion system for scuba divers of the present invention.

FIG. 7, on the other hand, shows the specific water jet (1F) complete with the electric wires with which it is fitted.

Figure 8:
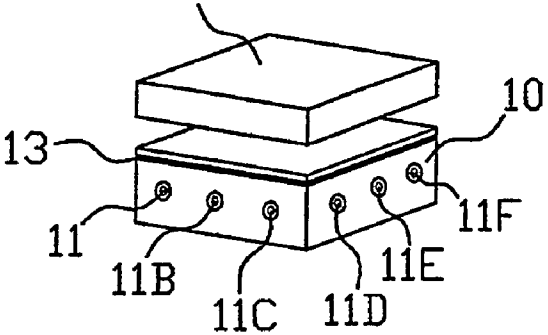
FIG. 8 is a perspective view of the watertight branch box of the preferred embodiment of the propulsion system for scuba divers of the present invention.

FIG. 8 shows the watertight branch box (10) in which the various wires of the power supply and control circuit are attached, complete with the relative intake holes (11, 11B, 11V, 11D, 11E, 11F) all equipped with the respective rubber stoppers that prevent the water from filtering in. At the top can be seen the cover (12) before it is applied and the rubber sealing ring (13).

Figure 9:
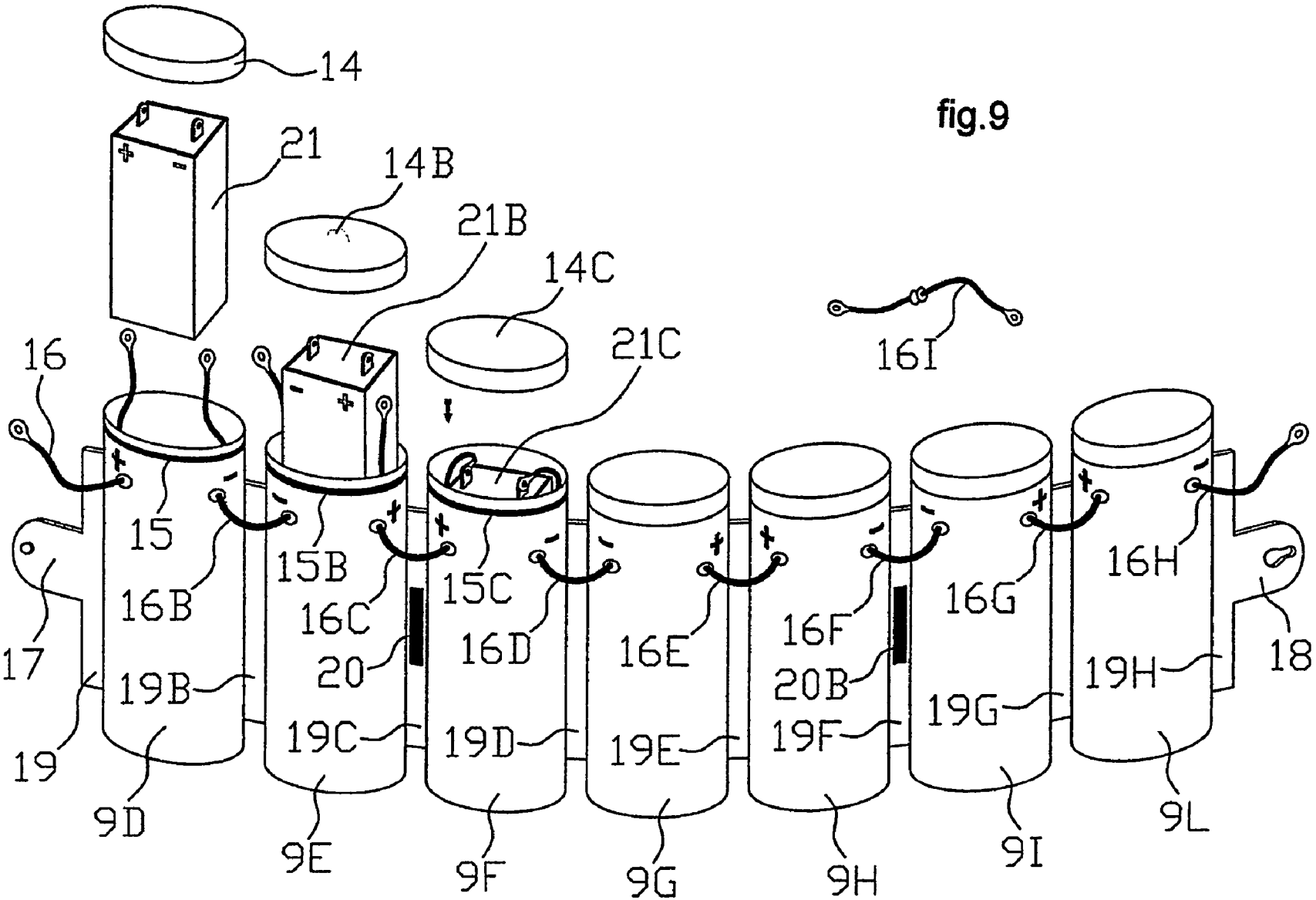
FIG. 9 is an exploded perspective view of the complete power supply system of the preferred embodiment of the propulsion system for scuba divers of the present invention.

FIG. 9 illustrates in detail the complete power supply system complete with all the parts that comprise it, in the following sequence: the specific caps (14, 14B, 14C) to be inserted under pressure on the watertight containers (9D, 9E, 9F, 9G, 9H, 9I, 9L) all advantageously equipped with sealing rings (15, 15B, 15C); the connecting cables (16, 16B, 16C, 16D, 16E, 16F, 16G, 16H, 16I); the two hooks (17, 18); the connecting interstices of rubber or other suitable material (19, 19B, 19C, 19D, 19E, 19F, 19G, 19H); the two "V"-section hooks (20, 20B) (optional); and the traditional batteries (use and discard) or rechargeable (21, 21B, 21C).

FIGS. 10–13 shows a series of details of the special power supply system.

Figures 10, 11, 12, 13:
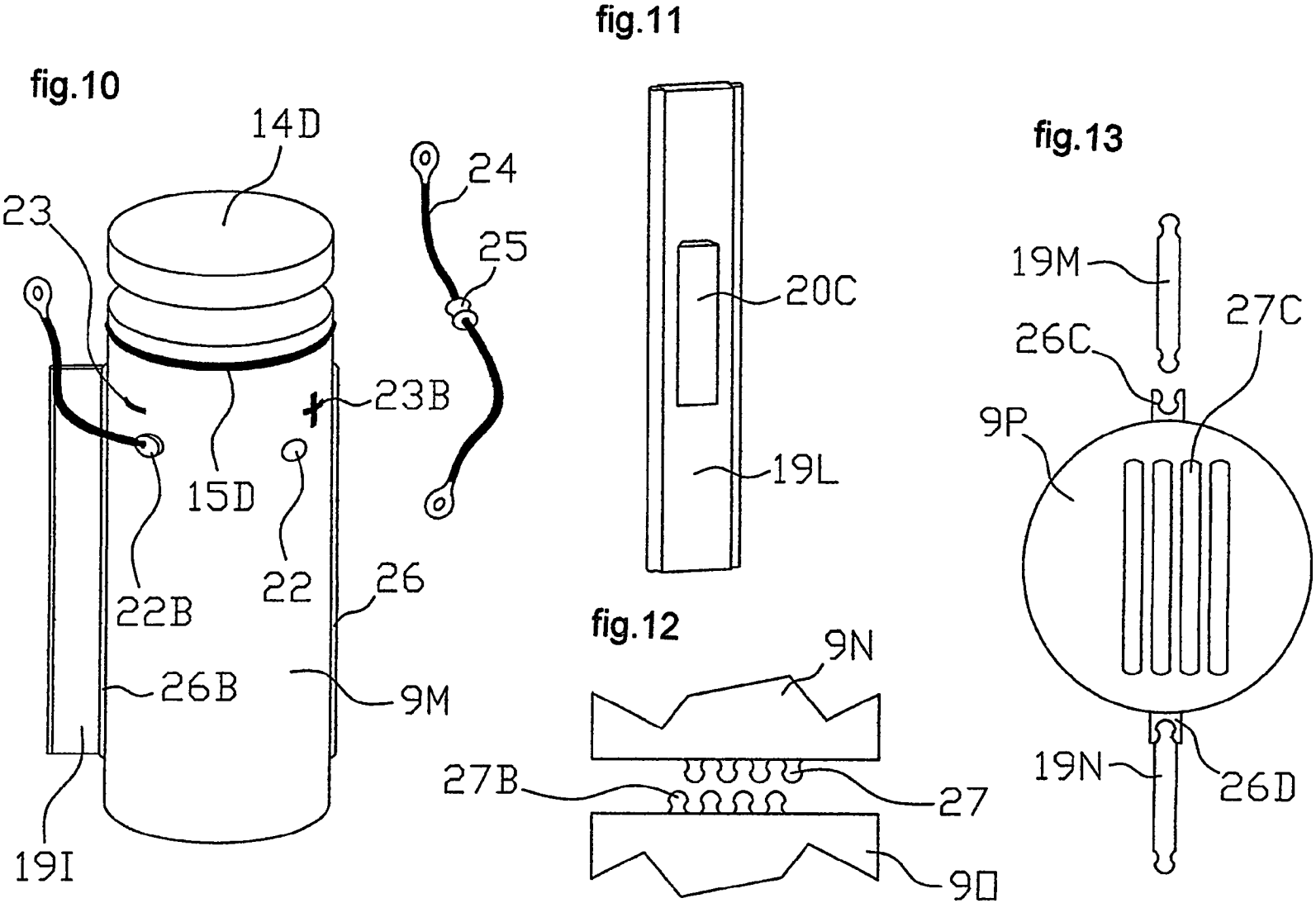
FIG. 10 is a perspective view of the watertight container of the preferred embodiment of the propulsion system for scuba divers of the present invention.
FIG. 11 is a perspective view of the connecting interstice of the preferred embodiment of the propulsion system for scuba divers of the present invention.
FIG. 12 is a perspective view of individual staggered sections of the preferred embodiment of the propulsion system for scuba divers of the present invention.
FIG. 13 is a top elevational view of the watertight container of the preferred embodiment of the propulsion system for scuba divers of the present invention.

FIG. 10 illustrates a watertight container (9M) inside of which the relative traditional or rechargeable batteries are positioned in the following sequence: the cover (14D) to be inserted under pressure on the container (9M); the sealing ring (15D) made of rubber or other suitable technical material; the two watertight connecting holes (22, 22B); the two polarity symbols (23, 23B) used for assembling; the connecting cable (24) with the corresponding sealing plug (25) of rubber or other suitable technical material; and the two guides (26, 26B) used to hook on the relative connecting interstices (19I) made of rubber or other suitable technical material.

FIG. 11 illustrates the connecting interstice (19L) of rubber or other suitable technical material to which is assembled a special block (20C) with a "V" section (optional) capable of fastening additional accessories.

FIG. 12 illustrates in detail the individual staggered sections (27, 27B) located in the lower part of all the watertight containers (9N, 9O). These sections are used when the watertight containers (9N, 9O) are to be fastened together to form different configurations of the power supply device.

FIG. 12 illustrates, in a top view, the lower part of the watertight container (9P) where the staggered sections can be seen (27C); the two guides (26C, 26D); the two connecting interstices (19M, 19N) are of rubber or other suitable technical material, one of which (19N) is inserted correctly and the other (19M) is outside its seat.

Reduced to its essential structure and with reference to the figures in the attached drawings, an innovative means of propulsion, validly supported by a special harness that can be used by scuba divers, deep-sea divers or simple amateurs, all of it advantageously powered by a sophisticated system of traditional or rechargeable batteries inserted inside various watertight containers joined together by means of interstices of rubber or other suitable technical material, according to the invention, includes:

means for moving around underwater thanks to specific electric water jets (1, 1B, 1C, 1E, 1F) validly supported by a harness (2, 2B, 2C) that hooks around the hips of the user and is powered by a system including a series of watertight cylinders (9, 9B, 9C, 9D, 9E, 9F, 9G, 9H, 9I, 9L, 9M, 9N, 9O, 9P) all containing a traditional or rechargeable battery/accumulator (21, 21B, 21C);

means for establishing any type of configuration of the innovative power supply system (6, 6B, 6C), thanks to the connecting interstices (19, 19B, 19C, 19D, 19E, 19F, 19G, 19H, 19I, 19L, 19M, 19N) of rubber or other suitable technical material, and a series of special staggered recesses (26, 26B, 26C, 26D, 27, 17B, 27C) located at the base of the watertight cylinders (9, 9B, 9C, 9D, 9E, 9F, 9G, 9H, 9I, 9L, 9M, 9N, 9O, 9P);

means for connecting the various cables of the power supply and control circuit inside a special watertight branch box (10), complete with the relative intake holes (11, 11B, 11C, 11D, 11E, 11F) advantageously equipped with the corresponding rubber stoppers (25) to prevent water from infiltrating inside;

means for controlling the entire system thanks to watertight push buttons (7, 7B) that could be combined with a strap (8) that can hold the buttons firmly in the palm of the hand, to be used when the diver, for various reasons, is not wearing a diving suit; means for attaching to the special harness (2, 2B, 2C) various types of accessories, thanks to reinforced holes (5, 5B, 5C, 5D, 5E, 5F, 5G, 5H, 5I, 5L, 5M, 5N, 5O, 5P) equipped with the corresponding supplementary bolts;

means for equipping the connecting interstices (19, 19B, 19C, 19D, 19E, 19F, 19G, 19H, 19I, 19L, 19M, 19N) of rubber or other suitable technical material, with a special block (20, 20B, 20C) with a "V" section capable of attaching possible additional accessories.

Advantageously, the special propulsion system can be readily configured in various solutions to allow all scuba divers, deep-sea divers, or amateurs to use it for work or for simple recreation.

Advantageously, the special harness (2, 2B, 2C) is able to clamp on various types of accessories such as specific water jets (1, 1B, 1C, 1D, 1E, 1F) thanks to reinforced holes (5, 5B, 5C, 5D, 5E, 5F, 5G, 5H, 5I, 5L, 5M, 5N, 5O, 5P) combined with the relative bolts or using other clamping systems, without adversely affecting its proper operation.

Advantageously, the special propulsion system may be equipped with watertight push buttons (7, 7B) to make it possible to control with one hand the activation/deactivation of the entire system.

Advantageously, the battery accessory (6, 6B, 6C) can be used to power the entire system covered by the patent or for other similar purposes, all thanks to the versatility of the construction design.

Advantageously, the system covered by the patent has some special technical features capable of preventing water from infiltrating the electrical and electronic systems and irremediably compromising proper operation.

Advantageously, the special propulsion system may be constructed using the most disparate materials on the market today. It will, as a matter of fact, be possible to use common plastic materials, aluminum, fiberglass, carbon, all composite alloys, and even to use different metals such as iron, steel, brass and all their derivatives.

In any event, the execution details can vary in practice in an equivalent manner with regard to form, dimensions, layout of the elements, nature of the materials used, without departing from the context of the solution idea and therefore remaining within the boundaries of the protection granted by this industrial invention patent.

The invention claimed is:

1. An underwater propulsion system for propelling a user through the water, comprising:

a harness having at least two hooks for securing said harness around the user;

a power supply system having at least one watertight container attachable to said harness, wherein said watertight container being adapted to receive a removable power source;

at least one water jet removably attachable to said harness, wherein said water jet being electrically connected to said power source; and a watertight switch electrically connected to said power source and said water jet;

wherein said harness defines multiple reinforced holes adapted to receive a fastener therethrough.

2. The underwater propulsion system as set forth in claim 1, wherein said water jet being adapted to receive said fastener of said harness for securing said water jet to said harness.

3. The underwater propulsion system as set forth in claim 1 further comprising a watertight box for enclosing the electrical connections of said power source, said switch, and said water jet, wherein said watertight box being removably attachable to said harness.

4. The underwater propulsion system as set forth in claim 1, wherein said watertight container further comprising at least one watertight connecting hole.

5. The underwater propulsion system as set forth in claim 1 further comprising at least one connecting interstice, said connecting interstice being removably connected to said power supply system and said harness.

6. The underwater propulsion system as set forth in claim 5, wherein said connecting interstice has a special block with a "V" section capable of fastening additional accessories thereto.

7. The underwater propulsion system as set forth in claim 1, wherein said watertight container features an open top, a sealing ring located adjacent said open top, and a cap adapted to cover said open top and said sealing ring to produce a watertight connection.

8. The underwater propulsion system as set forth in claim 1, wherein said watertight container further comprising at least two watertight connecting cables which are connected to said power source received therein.

9. The underwater propulsion system as set forth in claim 1 further comprising at least one individual staggered section for connecting at least two watertight containers together.

10. The underwater propulsion system as set forth in claim 1, wherein said switch being secured to said user via a strap.

11. The underwater propulsion system as set forth in claim 10, wherein said switch is contoured to be comfortably received against the palm of the user when said strap is wrapped around the back of the hand to secure said switch to the palm.

12. An underwater propulsion system, comprising:

a harness adapted to be worn on the body of a user, said harness having at least two hooks for securing said harness around the user, wherein said harness features at least one reinforced hole;

a power supply system having at least one watertight container having at least two watertight connecting holes located on the exterior surface of said container, said watertight container being adapted to receive a removable power source therein;

at least one water jet removably attachable to said harness, said water jet being electrically connected to said power source;

a watertight switch electrically connected to said power source and said water jet;

a watertight box for enclosing the electrical connections of said power source, said switch, and said water jet, said box being removably attachable to said harness; and at least one connecting interstice being removably connected to said power supply system and said harness.

13. The underwater propulsion system as set forth in claim 12, wherein said connecting interstice has a special block with a "V" section capable of fastening additional accessories thereto.

14. The underwater propulsion system as set forth in claim 12, wherein said watertight container features an open top, a sealing ring located adjacent said open top, and a cap adapted to cover said open top and said sealing ring to produce a watertight connection.

15. The underwater propulsion system as set forth in claim 12, wherein said watertight container further comprising at least two watertight connecting cables which are electrically connected to said power source received therein.

16. The underwater propulsion system as set forth in claim 12 further comprising at least one individual staggered section for connecting at least two watertight containers together.

17. An underwater propulsion system, comprising:

a harness adapted to be releasably worn on the body of a user, said harness having at least two hooks for securing said harness around the user, and a plurality of reinforced holes;

a power supply system having a plurality of watertight containers having an open top, a sealing ring located adjacent said open top, at least two watertight connecting cables located on the exterior surface of said container, and a cap adapted to cover said open top and said sealing ring to produce a watertight connection;

a power source having electrical contacts, said power source being adapted to be received within said watertight container and electrically connected to said connecting cables;

at least one individual staggered section for connecting at least two watertight containers together, whereby multiple watertight containers can be interconnect together to form an array;

at least one connecting interstice, said connecting interstice being removably connected to said power supply system and said harness;

at least one water jet removably attachable to said harness, said motorized propulsion module being adapted to receive a fastener inserted through said reinforced holes for securing said water jet to said harness, said water jet being electrically connected to said power source;

a watertight switch electrically connected to said power source and said water jet, said switch having a strap adapted to be wrapped around the back of the hand of the user for securing said switch to the palm of the user; and a watertight box for enclosing the electrical connections of said power source, said switch, and said water jet, said box being removably attachable to said harness.

18. The underwater propulsion system as set forth in claim 17, wherein said connecting interstice has a special block with a "V" section capable of fastening additional accessories thereto.

* * * * *